US005735757A

United States Patent [19]

Moriyama

[11] Patent Number: 5,735,757

[45] Date of Patent: Apr. 7, 1998

[54] GOLF BALL

[75] Inventor: Keiji Moriyama, Shirakawa, Japan

[73] Assignee: Sumitomo Rubber Industries, Ltd., Hyogo-Ken, Japan

[21] Appl. No.: 670,494

[22] Filed: Jun. 27, 1996

[30] Foreign Application Priority Data

Jun. 27, 1995 [JP] Japan ..... 7-160764
May 21, 1996 [JP] Japan ..... 8-125615

[51] Int. Cl.[6] ..... A63B 37/14
[52] U.S. Cl. ..... 473/384
[58] Field of Search ..... 473/384, 383

[56] References Cited

U.S. PATENT DOCUMENTS 878,254 2/1908 Taylor .
4,979,747 12/1990 Jonkouski .
5,470,076 11/1995 Cadorniga ..... 473/384

FOREIGN PATENT DOCUMENTS 1-268579 10/1989 Japan .
2-102681 4/1990 Japan .
3-23184 3/1991 Japan .
3-198875 8/1991 Japan .

*Primary Examiner*—George J. Marlo
*Attorney, Agent, or Firm*—Birch, Stewart, Kolasch & Birch, LLP

[57] ABSTRACT

A golf ball of the present invention has a plurality of dimples on its surface. The dimples accounting for not less than twenty percent of a total number of dimples have a double radius shape in which the curvature of the bottom wall portion and the curvature of the peripheral wall portions extending from the upper end of the bottom wall portion to the opening of the dimple are different from each other. The double radius shape is set so that the relationship between a diameter D1 at the opening of the dimple and a diameter D2 at the inflection point falls within $0.95 \geqq D2/D1 \geqq 0.50$ and the relationship between the depth F to the deepest point of the dimple and the depth C to the inflection point falls within $1.00 > C/F \geqq 0.85$.

6 Claims, 6 Drawing Sheets

GOLF BALL

BACKGROUND OF THE INVENTION

1. Field of the Invention

The present invention relates to a golf ball, and more particularly, to the improvement of dimples formed in a double radius shape for increasing the ball carry by efficiently disturbing the flow of air around the golf ball during flight.

2. Description of the Prior Art

The surface of a golf ball is normally provided with 280 to 540 dimples. As is well known, the dimples have the following two roles: increasing the carry by reducing the pressure resistance loaded on the golf ball through disturbance of the air flow around the golf ball during the flight of the golf ball for promoting a turbulent transition in a boundary layer and causing a turbulent separation so as to shift the separation point rearward; and raising the loft of the trajectory by increasing the lift of the golf ball through promotion of a difference in the vertical direction between separation points.

Therefore, a dimple which can disturb more of the air flow around the golf ball is a dimple having aerodynamic superiority. Accordingly, a variety of improvements have been effected on the dimple of a golf ball.

There has been an attempt at optimizing the factors of, for example, the volume of each dimple, the occupation rate of the dimples on the surface of the golf ball, dimple arrangement and so forth. However, there has been a limit to merely improving such factors. Therefore, the present applicant has provided a golf ball obtained by improving the shape of the dimple itself to include two types of curved surfaces (double radius) having different curvatures (Japanese Patent Publication No. 3-23184).

According to the above-mentioned conventionally provided dimple having a double radius shape, the curvature is varied in each dimple so that the air flow can be disturbed, even in each dimple. However, the effect has been so insignificant that the ball carry has not been remarkably increased and also it has been difficult to obtain the desired loft of trajectory.

SUMMARY OF THE INVENTION

In view of the above, the present inventor has further conducted earnest researches and experiments. As a result, the inventor has found that the ball carry can be increased and the loft of the trajectory can be raised more than in golf balls provided with the conventional double radius dimples by establishing a relationship between the diameter of the dimple at the opening end and the diameter at the inflection point at which the curvature changes as well as the relationship between the depth to the deepest portion of the dimple and the depth to the inflection point, within respective required ranges, and by establishing the occupational rate, i.e. the number of the double radius dimples with respect to the total number of dimples within a required range. The present invention has been developed based on the above-mentioned research and experimentation.

Accordingly, an object of the present invention is to provide a golf ball capable of an increased carry and an increased loft of trajectory by improving the design of dimples having a double radius shape.

That is, according to the present invention, there is provided a golf ball having a plurality of dimples on its surface, wherein the dimples accounting for not less than twenty percents of a total number of dimples are each formed into a double radius shape, in which the curvature of the bottom wall portion and the curvature of the peripheral wall portion of the dimples extending from an upper end of the bottom wall portion to the opening end are different from each other, and wherein the double radius shape is set so that D2/D1 falls within the following equation $$0.95 \geqq D2/D1 \geqq 0.50$$

where D1 is the diameter at the open end of each of the dimples, and D2 is the diameter of a circle formed by the inflection points of the curvatures, and where C/F falls within the following equation $$1.00 > C/F \geqq 0.85$$

where F is the length of a perpendicular from the ball virtual spherical surface to the deepest portion of the dimple, and C is the length of a perpendicular from the ball virtual spherical surface to a center of the circle formed by the inflection points.

The reason why there is set a range of $0.95 \geqq D2/D1 \geqq 0.50$ is that, when D2/D1 is greater than 0.95, it is difficult to take the ball out of a mold in terms of manufacturing the golf ball. On the other hand, when D2/D1 is smaller than 0.5, the required loft of the trajectory cannot be obtained. It is preferable to make D2/D1 as great as possible within the range of 0.6 to 0.95. Further, it is preferable to set D1 to 1.5–5.0 mm and set D2 to 0.9–4.75 mm.

The reason why there is the setting of $1.00 > C/F \geqq 0.85$ is that the trajectory becomes too high when C/F is not smaller than 1.00, and that neither the required carry nor the required loft of the trajectory can be obtained when C/F is smaller than 0.85. It is to be noted that C/F is preferably made as great as possible within the above-mentioned range.

According to the golf ball of the present invention, it is preferable to provide a total number of dimples not less than 400 and not greater than 500; form all of these dimples into dimples having the aforementioned double radius shape; and provide dimples of a plurality of types having different diameters.

For example, there are provided 50 dimples each having a diameter of 4.20 mm,
210 dimples each having a diameter of 3.80 mm,
110 dimples each having a diameter of 3.40 mm,
and
40 dimples each having a diameter of 3.20 mm,
consequently providing a ball with 410 total dimples.

In regard to the dimples provided on the golf ball, it is acceptable to provide at least twenty percent of the total number of dimples with a double radius and provide the balance of the dimples with a single radius (dimples where the curvature of its bottom wall portion and the curvature of its peripheral wall portion are identical). However, it is preferable to increase the amount of the double radius dimples, and it is most preferable to form all the dimples on the gold ball into double radius dimples having the aforementioned specifications.

Furthermore, it is preferable to set the total volume of the dimples to 270 to 340 $mm^3$.

According to experimental results as described later, it has been confirmed that the golf ball provided with the double radius dimples having the relation between D1 and D2 and the relation between C and F is able to improve its aerodynamic characteristics by disturbing the air flow around the golf ball in flight more than in conventional golf balls, consequently increasing its carry and raising the loft of the trajectory.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENT

Figure 2:
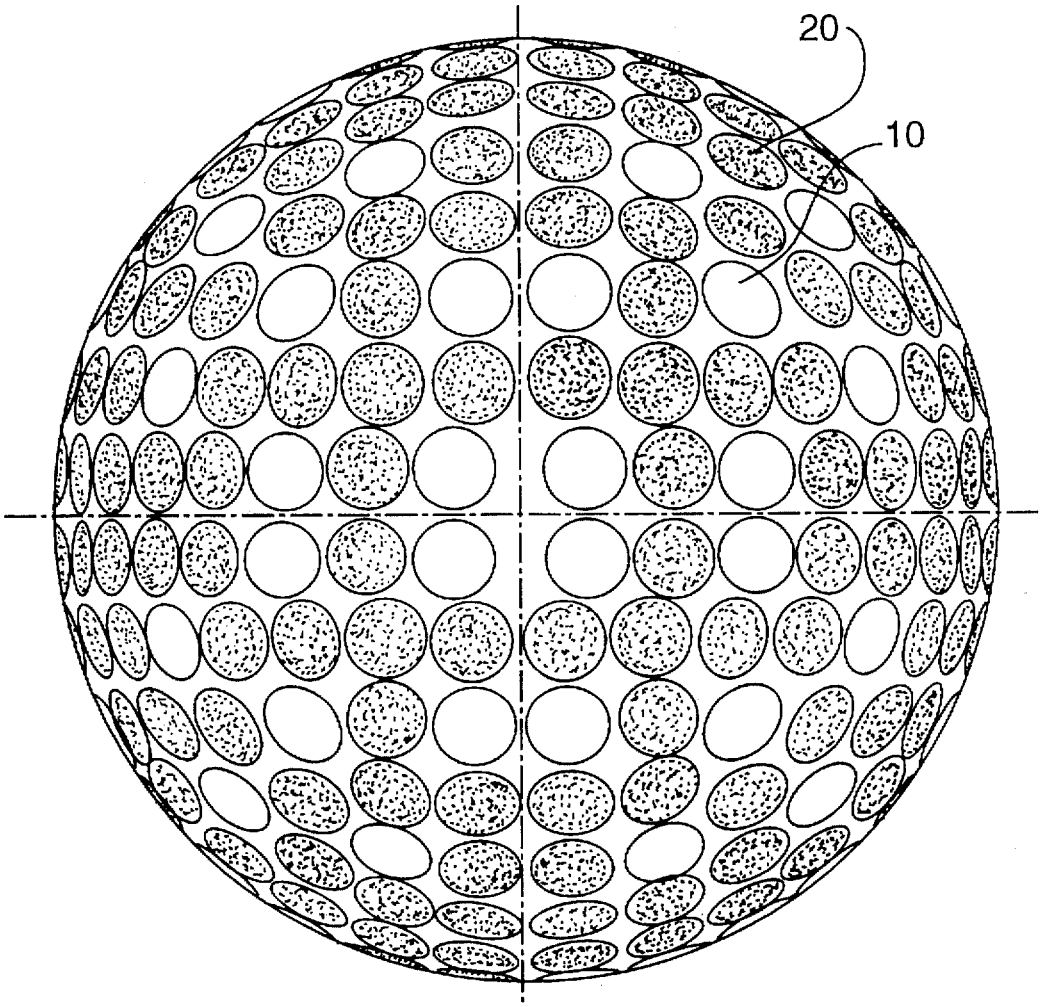
FIG. 2 is a front view of a golf ball according to a first embodiment of the present invention.
Figure 3:
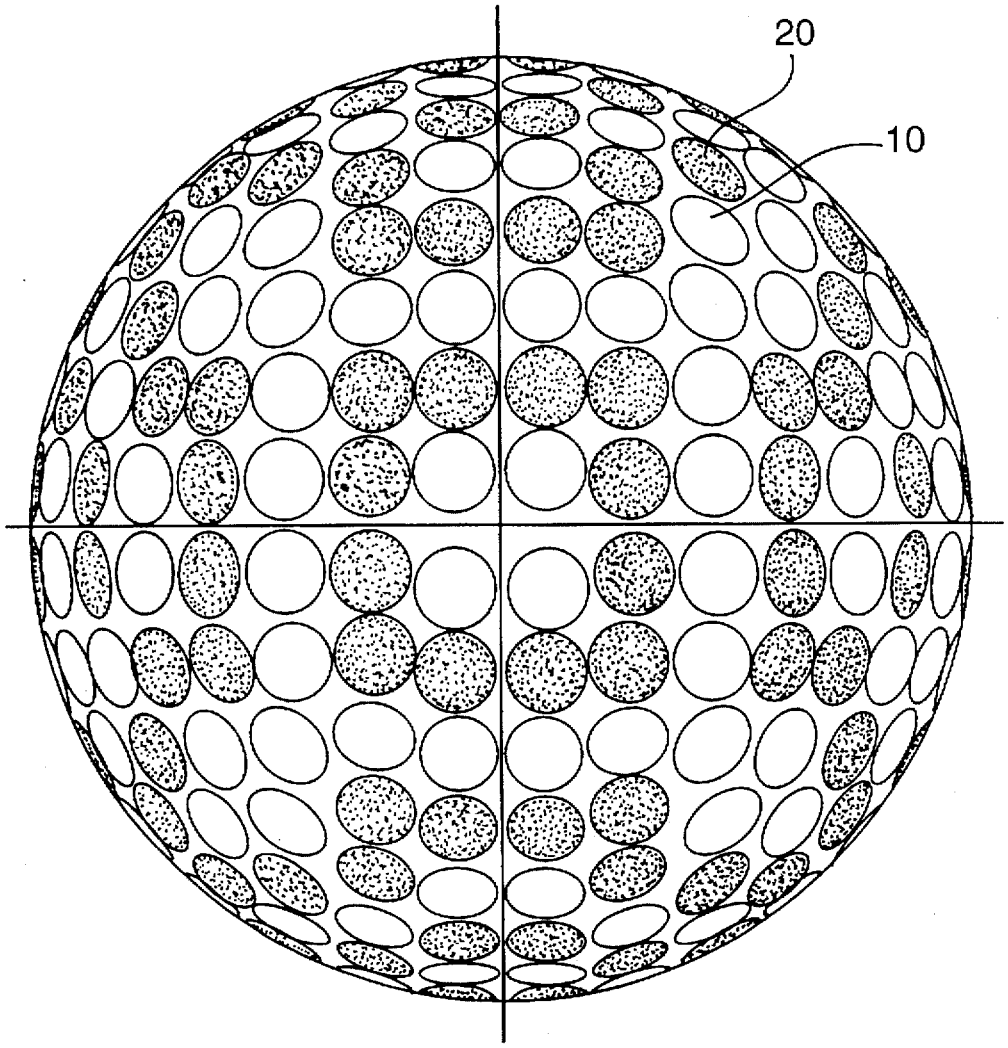
FIG. 3 is a front view of a golf ball according to a second embodiment of the present invention.
Figure 4:
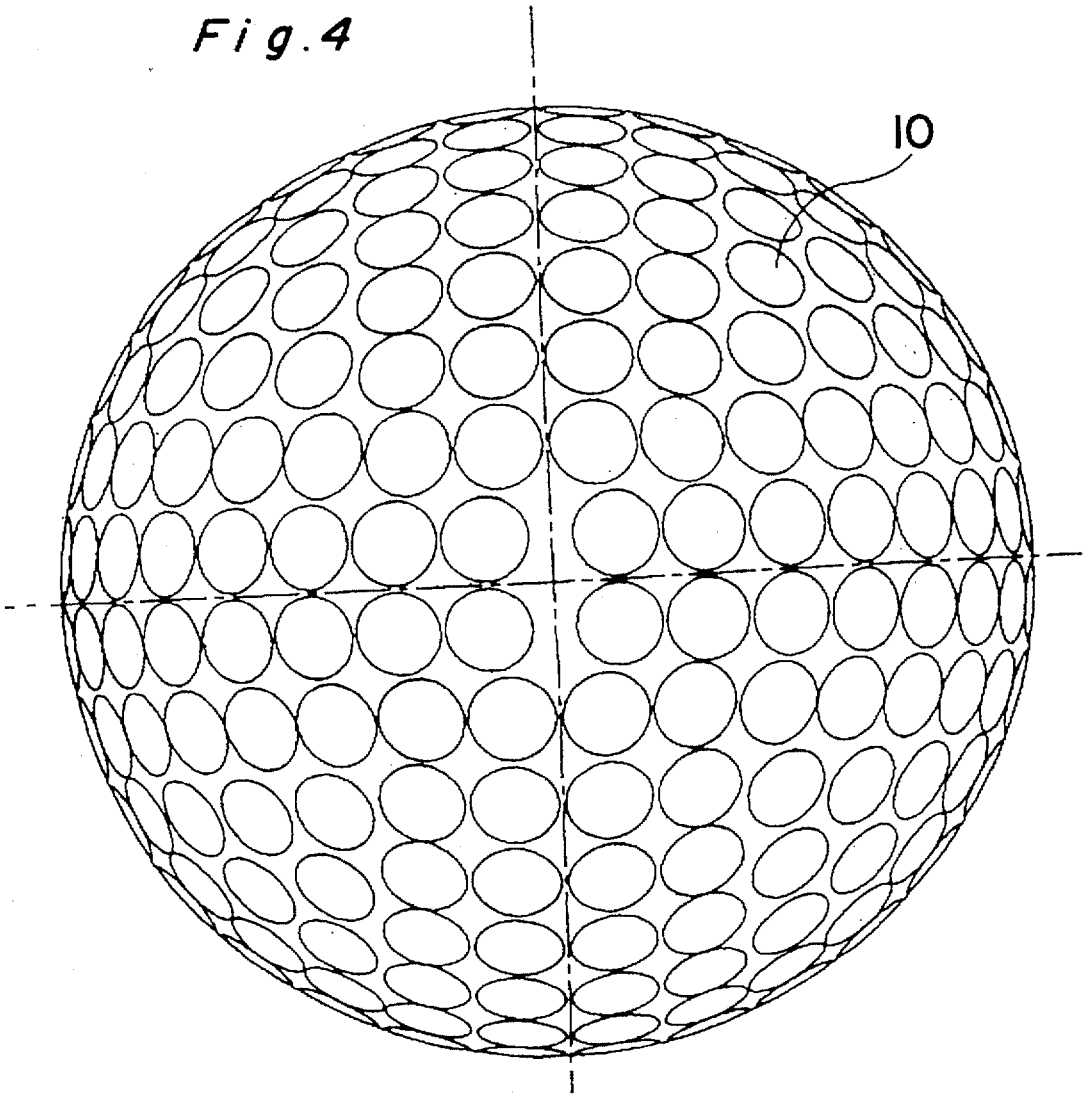
FIG. 4 is a front view of a golf ball according to the third, fourth, fifth and sixth embodiments and the second and third comparative examples of the present invention.
Figure 5:
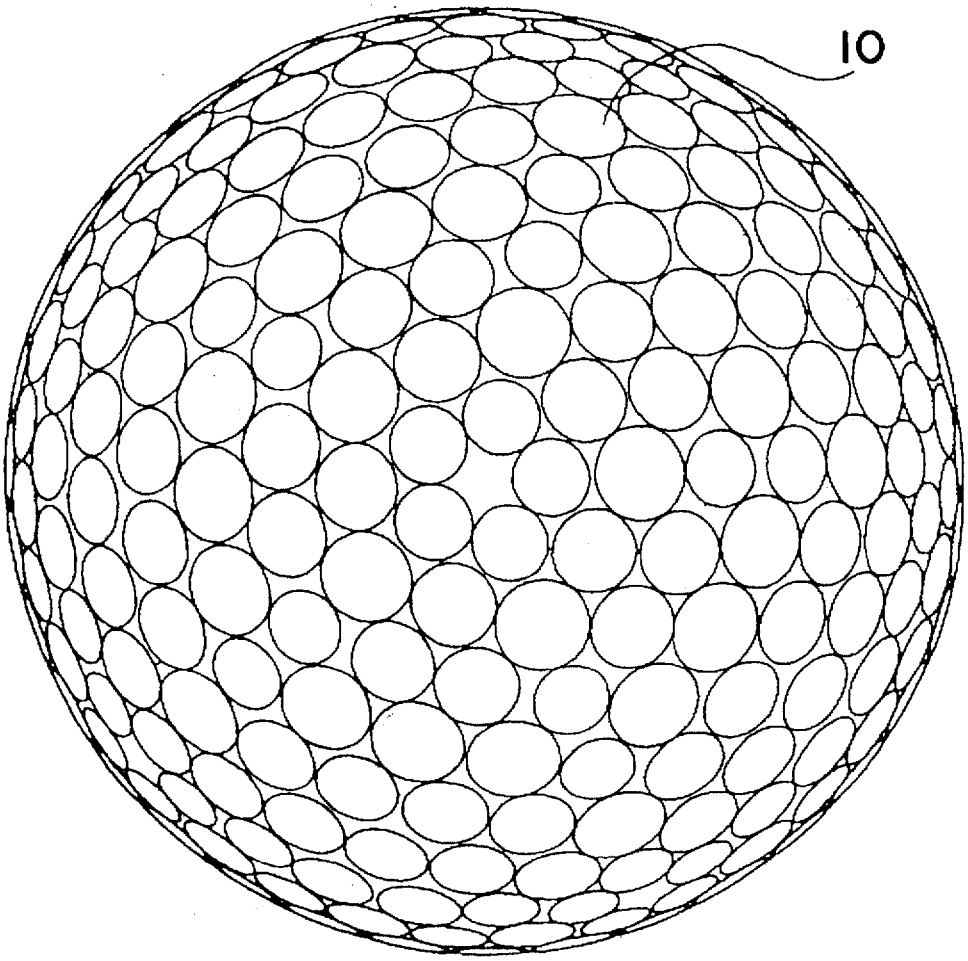
FIG. 5 is a front view of a golf ball according to the seventh embodiment of the present invention.
Figure 6:
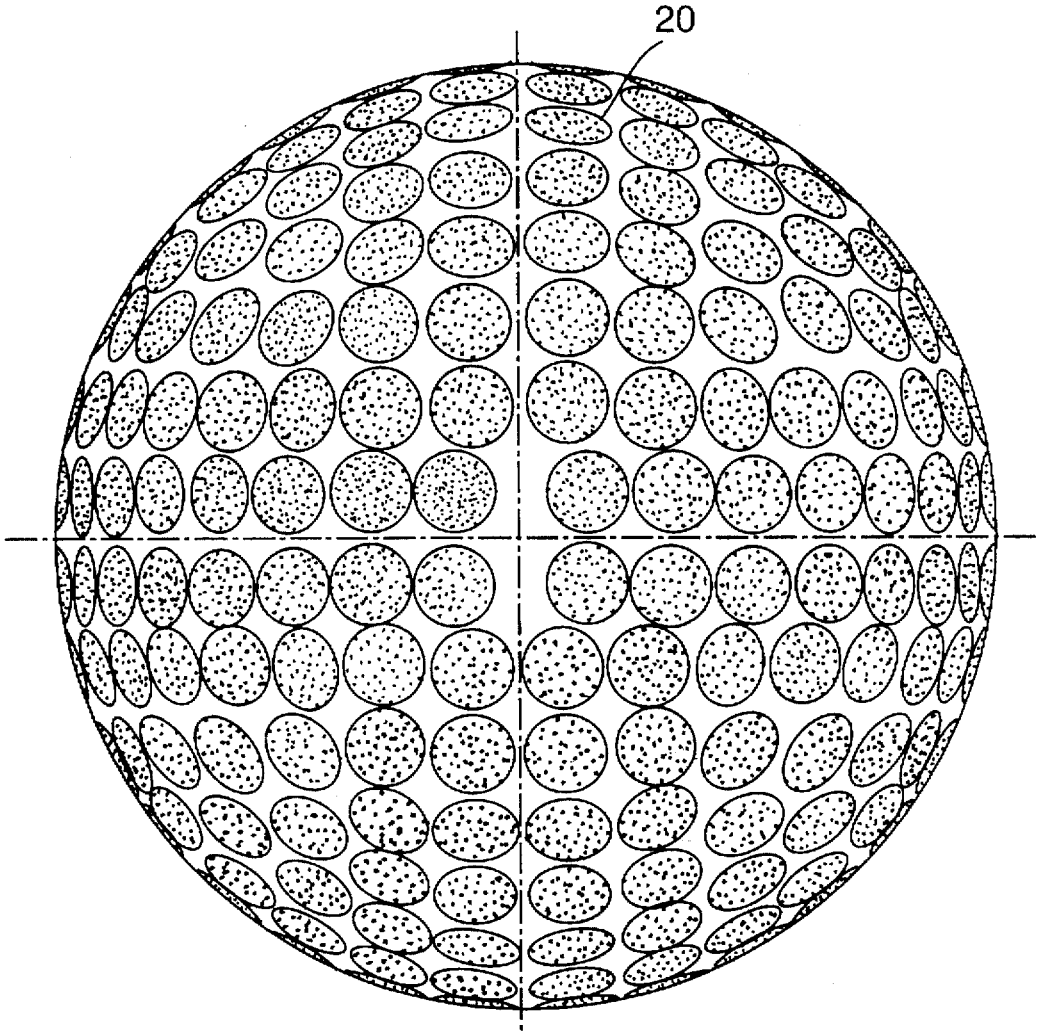
FIG. 6 is a front view of a golf ball according to the first comparative example.

FIG. 2 shows a golf ball according to a first embodiment in which double radius dimples 10 (indicated by white circles in FIG. 2) and single radius dimples 20 (indicated by black circles in FIG. 2) are provided in mixture. FIG. 3 shows a golf ball according to a second embodiment in which double radius dimples 10 (indicated by white circles in FIG. 3) and single radius dimples 20 (indicated by black circles in FIG. 3) are provided in mixture. FIG. 4 shows a golf ball according to a third, fourth, fifth and sixth embodiments and second and third comparative examples in which only the double radius dimples 10 are provided. FIG. 5 shows a golf ball according to a seventh embodiment in which only the double radius dimples 10 having different diameters are provided. FIG. 6 shows a golf ball according to a first comparative example in which only the single radius dimples 20 are provided in mixture.

It is to be noted that all the dimples have an identical diameter except for those of the seventh embodiment shown in FIG. 5.

The specifications of the golf balls of the first through seventh embodiments and the specifications of the first through third comparative examples are as shown in Table 1 provided below.

It is to be noted that the golf balls of the embodiments and the comparative examples are all two-piece golf balls each comprised of double layer construction of a core and a cover having an outer diameter of 42.75±0.05 mm, a compression of 95±3 and an inner core diameter of 38.4 mm.

TABLE 1

| | Dimple specifications | | | | | | | |
|---|---|---|---|---|---|---|---|---|
| | Total | Single radius dimple | | Double radius dimple | | | | Total |
| | number of dimples | Diameter (mm) | Number of dimples | Diameter (mm) | D2/D1 | C/F | Number of dimples | dimple volume ($m^3$) |
| First embodiment | 336 | 3.70 | 264 | 3.70 | 0.75 | 0.85 | 72 | 319.3 |
| Second embodiment | 336 | 3.70 | 168 | 3.70 | 0.75 | 0.85 | 168 | 320.2 |
| Third embodiment | 336 | — | — | 3.70 | 0.75 | 0.85 | 336 | 319.8 |
| Fourth embodiment | 336 | — | — | 3.70 | 0.60 | 0.85 | 336 | 319.5 |
| Fifth embodiment | 336 | — | — | 3.70 | 0.90 | 0.85 | 336 | 319.6 |
| Sixth embodiment | 336 | — | — | 3.70 | 0.75 | 0.95 | 336 | 320.1 |
| Seventh embodiment | 410 | — | — | 4.20 | 0.75 | 0.85 | 50 | 320.6 |
| | | | | 3.80 | 0.75 | 0.85 | 210 | |
| | | | | 3.40 | 0.75 | 0.85 | 110 | |
| | | | | 3.20 | 0.75 | 0.85 | 40 | |
| First comparative example | 336 | 3.70 | 336 | — | — | — | — | 319.3 |
| Second comparative example | 336 | — | — | 3.70 | 0.40 | 0.85 | 336 | 319.5 |
| Third comparative example | 336 | — | — | 3.70 | 0.75 | 0.80 | 336 | 320.0 |

Figure 1A:
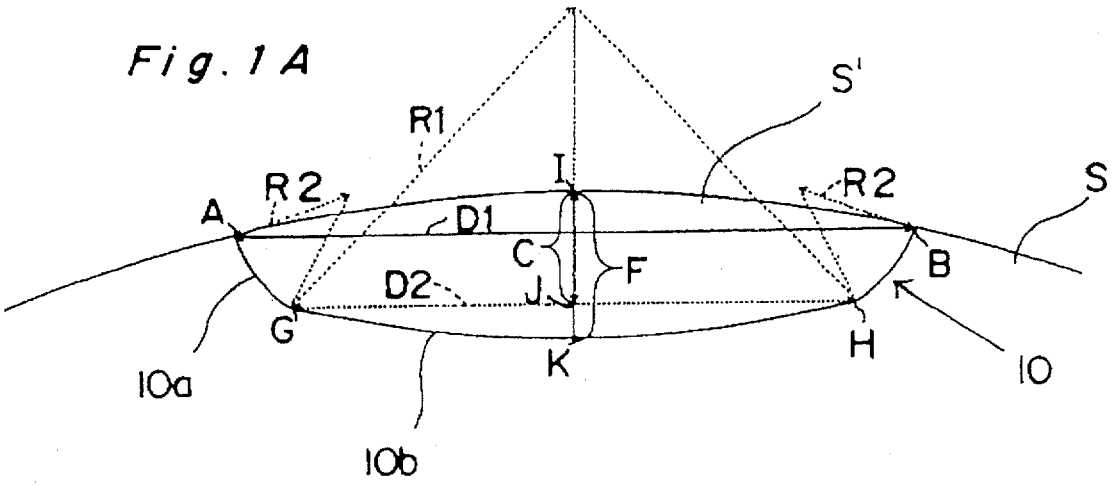
FIGS. 1A and 1B are views for explaining the specifications of a double radius dimple.
Figure 1B:
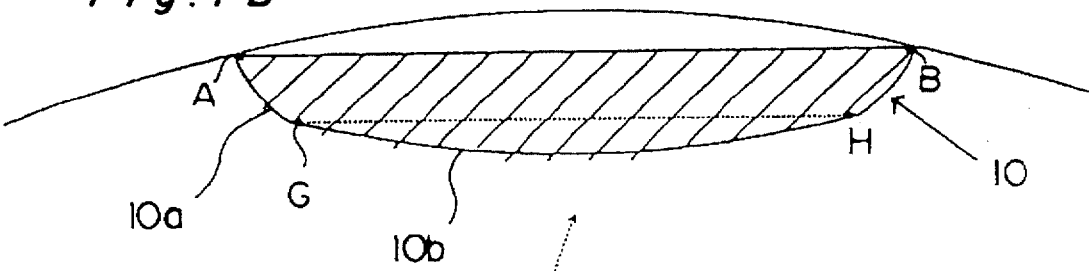
Figure 1C:
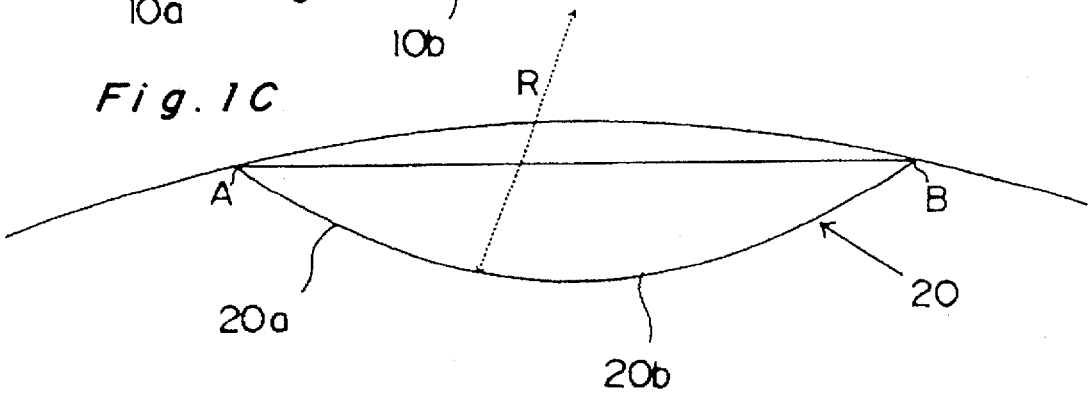
FIG. 1C is a view for explaining the specifications of a single radius dimple.

Referring to FIG. 1, the specifications of the dimples of the above golf balls will be described hereinafter. Both the double radius dimple 10 shown in FIGS. 1 (A) and (B) and the single radius dimple 20 shown in FIG. 1 (C) have a surface opening portion of a complete circular shape, and are formed into concave shapes which extend from their opening edges and include peripheral wall portion 10*a* and 20*a* as well as bottom wall portions 10*b* and 20*b*.

In the double radius dimple 10, the curvature of the bottom wall portion 10*b* and the curvature of the peripheral wall portion 10*a* which extends from the upper end of the bottom wall portion 10*b* to the opening edge are made different from each other. On the other hand, the single radius dimple 20 has an identical curvature extending from the lowermost point of the bottom wall portion 20*b* through the peripheral wall portion 20*a* to the opening edge.

In Table 1, the dimple diameter (D1) represents the diameter at the opening end, or the distance between both contact points A and B of a common tangent connected between both left hand and right hand opening edges of each of the dimples 10 and 20, i.e., the distance A–B in FIG. 1. In the double radius dimple 10, (D2) represents a diameter of a circle formed by inflection points of the curvatures, or the distance between both left hand and right hand inflection points G and H located at the boundary of the curvature R1 of the bottom wall portion 10*b* and the curvature R2 of the peripheral wall portion 10*a*, i.e., the distance G–H in FIG. 1.

In Table 1, (F) represents the length of a perpendicular from a ball virtual spherical surface S' above the opening of each of the dimples 10 and 20 to the deepest portion of each dimple, while (C) represents the length of a perpendicular from the ball virtual spherical surface S' to a center of the circle formed by the inflection points, or to a straight line G–H which connects the both left hand and right hand inflection points.

The volume of each of the dimples 10 and 20 is the volume of a region indicated by the hatching in the figure extending from the dimple diameter D1 to the bottom wall side. The sum total of the volumes of all the dimples of one golf ball is the total volume.

In regard to each of the golf balls of the first through seventh embodiments and first through third comparative examples of the present invention, the total dimple volume is set at 270 to 340 $mm^3$. This setting is selected because the golf ball disadvantageously becomes too lofty when the volume is less than 270 $mm^3$ and its trajectory is disadvantageously suppressed to a low value when the volume exceeds 340 $mm^3$ resulting, in each case, in failure to yield a long carry.

According to the first through seventh embodiments of the present invention, dimples accounting for not less than 20% of the total number of dimples are formed into a double radius shape, and the relations between (D1) and (D2) is set according to the following equation (1).

$$0.95 \geqq D2/D1 \geqq 0.50 \quad (1)$$

The reason why D2/D1 is made not greater than 0.95 is that, when it exceeds 0.95, it is difficult to take the ball out of a mold at the time of forming the ball. Furthermore, the reason why D2/D1 is not smaller than 0.50 is that, when D2/D1 is smaller than 0.50, neither the required carry nor the required loft of trajectory can be obtained.

Further, the relationship between (F) and (C) are set according to the following equation (2).

$$1.00 > C/F \geqq 0.85 \quad (2)$$

As described hereinbefore, the reason why C/F is made not smaller than 0.85 is that neither the required carry nor the required loft of trajectory can be obtained when it is smaller than 0.85, and that the trajectory becomes too lofty when it is made greater than 1.00.

In particular, in the case of the golf ball of the first embodiment shown in FIG. 2, dimples accounting for 21.4% of the total number of dimples are double radius dimples 10. The double radius dimples 10 and the single radius dimples 20 are single dimples each having an identical dimple diameter D1 of 3.70 mm. Further, each of the double radius dimples 10, counting 72 in the number of dimples, is set so that D2/D1=0.75 within the range of the aforementioned equation (1) and C/F=0.85 within the range of the aforementioned equation (2).

In the case of the golf ball of the second embodiment shown in FIG. 3, dimples accounting for 50% of the total number of dimples are double radius dimples 10. The double radius dimples 10 and the single radius dimples 20 are single dimples each having an identical dimple diameter D1 of 3.70 mm similarly to the first embodiment. Further, each of the double radius dimples 10, counting 168 in the number of dimples, is set so that D2/D1=0.75 within the range of the aforementioned equation (1) and C/F=0.85 within the range of the aforementioned equation (2).

In the case of the golf balls of the third embodiment, fourth embodiment, fifth embodiment and sixth embodiment shown in FIG. 4, all the dimples are double radius dimples 10 that are single dimples each having an identical dimple diameter. They are each set so that D2/D1 and C/F fall within the ranges of the aforementioned equation (1) and equation (2).

According to the second comparative example and the third comparative example, the golf ball has the same shape as that of the aforementioned third through sixth embodiments shown in FIG. 4. All the dimples are double radius dimples 10 that are single dimples each having an identical dimple diameter. However, in the second comparative example, C/F=0.85 within the range of the equation (2), whereas D2/D1=0.40 falling out of the range of the equation (1). In the third comparative example, D2/D1=0.75 within the range of the equation (1), whereas C/F=0.80 falling out of the range of the equation (2).

In the case of the golf ball of the seventh embodiment shown in FIG. 5, all the dimples are double radius dimples 10, whereas the dimples have different diameters of four types. However, all the dimples are set so that D2/D1=0.75 and C/F=0.85, within the ranges of the equation (1) and the equation (2). Further, only the golf ball of the seventh embodiment has a total number of dimples of 410 differently from the other golf balls each having a total number of dimples of 366.

In the case of the golf ball of the first comparative example shown in FIG. 6, all the dimples are comprised of the single radius dimples 20 that are single dimples each having an identical dimple diameter and have a diameter of the same dimensions as those of the dimples of the third embodiment and so forth. Since the golf ball of the first comparative example has the single radius dimples, D2/D1 and C/F do not exist.

EXPERIMENTS

Twenty golf balls of each of the first through seventh embodiments and the first through third comparative examples were prepared. The golf ball were subjected to a flight distance test with a driver (W#1) at a head speed of 45 m/s by means of a swing robot produced by True Temper Corp.. A head wind flowed at the time of the test, and the wind velocity was 0.6 to 1.3 m/s.

Each golf ball was subjected to measurement of carry and loft of trajectory. The carry means a distance from a hitting point of the golf ball to a point at which the golf ball firstly landed, and represents the carry. The loft of trajectory means an elevation angle of a topmost point of the trajectory viewed from the hitting point. The greater the elevation angle is, the higher the loft of trajectory of the golf ball is.

The measurement results are shown in Table 2 provided below. The data shown in Table 2 are each mean value of the twenty golf balls subjected to the test in either the embodiments and the comparative examples.

TABLE 2

| Experiment results | Carry (YARD) | Loft of trajectory (°) |
|---|---|---|
| First embodiment | 227.1 | 14.19 |
| Second embodiment | 227.9 | 14.22 |
| Third embodiment | 229.1 | 14.29 |
| Fourth embodiment | 228.7 | 14.26 |
| Fifth embodiment | 230.0 | 14.35 |
| Sixth embodiment | 229.4 | 14.31 |
| Seventh embodiment | 230.5 | 14.40 |
| First comparative example | 225.9 | 14.09 |
| Second comparative example | 226.2 | 14.12 |
| Third comparative example | 226.5 | 14.16 |

An analysis of the test results shown in Table 2 is as follows.

The first embodiment through the third embodiment are identical to one another in that they have the same total number of dimples and have the single dimples each having an identical dimple diameter, and in that D2/D1=0.75 and C/F=0.85. They differ from one another in that they have different amounts of the number of double radius dimples relative to the total number of dimples. The greater the amount of the double radius dimples 10, the greater was the carry and the loft of the trajectory.

Further, the first comparative example is identical to the first embodiment through the third embodiment in that it has the same total number of dimples and the same single dimples each having an identical dimple diameter. The first comparative example differs from the first embodiment through the third embodiment in that it has only the single radius dimples 20, so that the occupation rate of the double radius dimples 10 amounts to 0% of the total number of dimples. The first comparative example exhibited a shorter carry and a lower loft of trajectory than in the first embodiment.

Thus, the carry and the loft of the trajectory gradually increases in the increasing order of the amount of the double radius dimples per ball, i.e., in the order of the first comparative example→first embodiment→second embodiment→third embodiment.

In particular, the first embodiment in which the rate of the double radius dimples is 21.4% exhibited about one yard increase of the carry and 0.07° increase of the loft of trajectory in comparison with the first comparative example in which the amount of the double radius dimples is 0%. Therefore, it has been confirmed that, by making the double radius dimples account for not less than 20% of the total number of dimples, there is achieved the effect of increasing the carry and the loft of the trajectory.

The third embodiment, fourth embodiment, fifth embodiment and the second comparative example are identical to one another in that they have the same total number of dimples and have single dimples each having an identical dimple diameter, all the dimples are comprised of the double radius dimples 10 and C/F=0.85. However, only the ratio D2/D1 is varied, being set at 0.40 in the second comparative example, at 0.75 in the third embodiment, at 0.60 in the fourth embodiment and at 0.90 in the fifth embodiment.

According to the test results, the carry and the loft of trajectory gradually increased in the increasing order of D2/D1 per ball, i.e., in the order of the second comparative example→fourth embodiment→third embodiment→fifth embodiment.

As described above, when D2/D1=0.40 in the second comparative example, the carry was 226.2 yards, and the loft of trajectory was 14.12°. In contrast to this, when D2/D1=0.60 in the fourth embodiment, the carry was 228.7 yards and the loft of trajectory was 14.26°, each exhibiting remarkable improvement. Therefore, it has been confirmed that D2/D1 should be set to at least 0.50 or more, and more preferably to 0.60 or more.

The third embodiment, the sixth embodiment and the third comparative example are identical to one another in that they have the same total number of dimples and have single dimples, each having an identical dimple diameter. Also, all of the dimples are composed of the double radius dimples 10 and a D2/D1=0.75. However, only the ratio C/F is varied, being set at 0.85 in the third embodiment, at 0.95 in the sixth embodiment and at 0.80 in the third comparative example.

According to the test results, the carry and the loft of the trajectory gradually increases in the decreasing order of C/F per ball, i.e., in the order of the third comparative example→third embodiment→sixth embodiment.

As described above, when C/F=0.80 in the third comparative example, the carry was 226.5 yards, and the loft of trajectory was 14.16°. In contrast to this, when C/F=0.85 in the third embodiment, the carry was 229.1 yards and the loft of trajectory was 14.29°, each exhibiting a remarkable improvement. Therefore, it has been confirmed that C/F should be set at at least 0.85 or more.

The seventh embodiment is identical to the third embodiment in that all the dimples are double radius dimples, D2/D1=0.75 and C/F=0.85. However, the former is made different from the latter in that the total number of dimples is increased more than in the third embodiment and dimple diameters of four types are provided.

According to the test results, both the carry and the loft of trajectory were the greatest, proving that this embodiment is the best. According to the results, it has been confirmed that increasing the total number of dimples and providing a plurality of dimple diameters are preferable in terms of increasing the aerodynamic characteristics.

As is apparent from the above description, according to the golf ball of the present invention, the double radius dimples are made to account for not less than 20% of the total number of dimples, the ratio D2/D1 of the diameter D1 at the opening end of each double radius dimple to the diameter D2 at the inflection point is set within the required range, and the ratio C/F of the depth F to the deepest portion of the double radius dimple to the depth C to the inflection point is set within the required range. Therefore, the air flow around the golf ball at the time of flight of the golf ball can be disturbed more intensely, thereby allowing the carry to be increased and the loft of trajectory to be raised.

Furthermore, by increasing the total number of dimples of the golf ball, providing all these dimples with the double radius dimples and varying the diameter of the dimples, the air flow around the golf ball can be disturbed more intensely, the carry can be increased and the loft of trajectory can be raised, thereby allowing the aerodynamic characteristics of the golf ball at the time of flight to be improved.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

What is claimed is:

1. A golf ball of improved carry and loft of trajectory and having a plurality of dimples on its surface, wherein dimples accounting for not less than twenty percent of the total number of dimples are formed with a double radius shape in which the curvature of the peripheral wall portions of the dimple is smaller than the curvature of the bottom wall portion, and wherein the double radius shape is established such that D2/D1 falls within the following equation:

$$0.95 \geqq D2/D1 \geqq 0.50$$

wherein D1 is the diameter of the open end of each of the dimples, and D2 is the diameter of a circle formed by the inflection points of the curvatures, and wherein C/F falls within the following equation:

$$1.00 > C/F \geqq 0.85$$

wherein F is the length of the perpendicular from a ball virtual spherical surface to the dimples deepest portion, and C is the length of the perpendicular from the ball virtual spherical surface to the center of the circle formed by the inflection points.

2. The golf ball of claim 1, wherein D2/D1 is within the range of 0.6 to 0.95.

3. The golf ball of claim 1, wherein D1 is 1.5 to 5.0 mm and D2 is 0.9 to 4.75 mm.

4. The golf ball of claim 1, wherein the dimples have several different diameter sizes.

5. The golf ball of claim 1, wherein the total volume of the dimples is 270 to 340 $mm^3$.

6. The golf ball of claim 1, wherein all of the dimples have a double radius.

* * * * *